US009752415B2

(12) United States Patent
Moller et al.

(10) Patent No.: US 9,752,415 B2
(45) Date of Patent: Sep. 5, 2017

(54) INSERTION AND SETTING STRUCTURE

(71) Applicant: Cameron International Corporation, Houston, TX (US)

(72) Inventors: Tobias Moller, Uetze (DE); Matthias Wieneke, Celle (DE)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/783,432

(22) PCT Filed: Apr. 9, 2013

(86) PCT No.: PCT/EP2013/001045

§ 371 (c)(1),
(2) Date: Oct. 8, 2015

(87) PCT Pub. No.: WO2014/166510

PCT Pub. Date: Oct. 16, 2014

(65) Prior Publication Data

US 2016/0061007 A1 Mar. 3, 2016

(51) Int. Cl.
*E21B 41/04* (2006.01)

(52) U.S. Cl.
CPC ..... *E21B 41/04* (2013.01)

(58) Field of Classification Search
CPC ..... E21B 41/10; E21B 33/035; E21B 33/076; E21B 41/04
See application file for complete search history.

(56) References Cited

U.S. PATENT DOCUMENTS

| | | | | |
|---|---|---|---|---|
| 2002/0070026 | A1* | 6/2002 | Fenton | E21B 33/035 166/368 |
| 2003/0079881 | A1* | 5/2003 | Moss | E21B 19/22 166/339 |
| 2013/0008661 | A1* | 1/2013 | Hallunæk | E21B 41/04 166/341 |
| 2013/0071191 | A1* | 3/2013 | Buchan | F16L 1/26 405/170 |
| 2013/0240216 | A1* | 9/2013 | Mogedal | E21B 19/002 166/368 |

FOREIGN PATENT DOCUMENTS

| | | | | |
|---|---|---|---|---|
| EP | 2196622 | A1 | 6/2010 | |
| FR | 2555249 | A1 | 5/1985 | |
| GB | 2373271 | A * | 9/2002 | E21B 43/013 |
| NO | 333163 | B1 | 3/2013 | |
| NO | 2499744 | A * | 8/2013 | E21B 19/002 |
| WO | 2011073778 | A1 | 6/2011 | |
| WO | 2012065896 | A2 | 5/2012 | |

OTHER PUBLICATIONS

PCT International Search Report; Application No. PCT/EP2013/001045; Dated Nov. 19, 2013; 5 pages.

* cited by examiner

*Primary Examiner* — James G Sayre
(74) *Attorney, Agent, or Firm* — Fletcher Yoder, P.C.

(57) ABSTRACT

A running tool configured to insert and set a retrievable subsea unit (RSU) into a subsea tree includes a frame having a lock configured to lock and unlock the running tool with respect to the subsea tree, a drive configured to lower or lift the RSU with respect to an accommodation space of the subsea tree, and a module lock configured to releasably lock the RSU to the drive.

20 Claims, 13 Drawing Sheets

INSERTION AND SETTING STRUCTURE

CROSS-REFERENCE TO RELATED APPLICATION

This application is a US National Stage of International Application No. PCT/EP2013/001045, entitled "INSERTION AND SETTING STRUCTURE", filed Apr. 9, 2013, which is herein incorporated by reference in its entirety.

The present invention concerns an insertion and setting structure.

In subsea oil and gas production a corresponding subsea production system is arranged on the sea bed. One part of such subsea production system is, for example, a so-called Christmas tree. The Christmas tree comprises a number of means and devices which are generally constructed as modular components. Those are particularly advantageous in view of reliability of pre-engineered components, the adaptability to handle any field scenario or in view of flexibility to expand as development scenarios change.

Some of those modules are, for example, a subsea control module (SCM) which provides multiplexed electro-hydraulic control and monitoring of a wide variety of field functions including traditional tree functions, like manifold valve control, choke adjustment, position indication, etc. Another module is a subsea distribution unit (SDU). This provided hydraulic, chemical and electrical distribution between subsea system and a main control umbilical.

A further module is a subsea accumulator module (SAM). This provides a local source of hydraulic fluid.

Those modules as well as other modules may be stand alone unit or can be arranged in a corresponding subsea structure like a subsea production tree or, particularly, a Christmas tree.

During assembly of such a subsea production tree and in particular in view of replacement, installation, or removal during operational life of corresponding modules, it will be advantageous in case such modules are supported to the subsea production tree from sea level and are also inserted and set in a corresponding tree structure. For replacement, it will, of course, also be necessary to remove the corresponding module.

For said transportation of corresponding modules, an insertion and setting structure is used which may be connected to a lift line wheeled from a vessel on sea level. The corresponding insertion and setting structure is used for supporting at least one of such a module to the corresponding subsea production tree or from this tree back to the vessel.

According to the present invention such insertion and setting structure is used for inserting and setting a retrievable subsea unit (RSU), such as a subsea control module (SCM), subsea accumulator module (SAM), communication distribution unit (CDU) or the like. The corresponding RSU is inserted and set into a manifold, subsea tree or the like. The insertion and setting structure in particular comprises a frame with at least a locking means for locking and unlocking the structure with respect to the subsea tree, a lowering and lifting means for lowering and lifting the RSU with respect to an accommodation space of the subsea tree, and/or a module locking/unlocking means for releasably locking the RSU to the lowering and lifting means.

Within the insertion and setting structure the corresponding RSU is releasably held by the module locking/unlocking means until the structure arrives at the subsea tree. For coupling the structure to the subsea tree, the locking means will be used wherein simultaneously with such locking also the RSU will be arranged in a particular position with respect to the tree such that it can be connected to same. For such connection some displacement of the RSU is necessary, which is possible according to the lowering and lifting means as part of the insertion and setting structure. By this lowering and lifting means the RSU will be lowered to be arranged in a corresponding accommodation space of the subsea tree and to be in a position to be connected to same. Corresponding module locking/unlocking means for releasably locking the RSU is provided for locking and unlocking the RSU with respect to the module lowering and lifting means.

Corresponding insertion and setting structure is generally called a "running tool" (RT).

With such a running tool, it is easily possible to transport a corresponding RSU to the subsea tree to install it in the tree, to remove the RSU from the tree and to transport it back to a vessel or the like on sea level for replacement or maintenance. Corresponding running tool may be used for a number of RSUs or may also be specified for transportation of only particular modules, like SCM, SAM, CDU or the like.

Moreover, on the seabed and for further manipulation of corresponding means of the insertion and setting structure also the use of, for example, a remotely operated vehicle (ROV) or the like will be necessary.

According to the insertion and setting structure of the invention it is easily possible to arrange a RSU within the structure, to temporarily fix it within the structure, to transport same with the structure to its operation area in particular in a subsea tree and to arrange it at its particular position in the subsea tree and connect it to same. Corresponding insertion and setting structure can also be used, of course, for removing the RSU from its operation area and to transport it back to sea level.

Corresponding features of such insertion and setting structure are disclosed in claim 1.

To provide a structure which may be easily adapted in view of different RSUs and which also may be easily assigned to a corresponding accommodation space of the subsea tree where the RSU should be arranged, the frame of the structure may comprise an upper frame module with the locking means, the lowering and lifting means, and/or the module locking/unlocking means and a lower frame module comprising for example the module locking/unlocking means with a RSU accommodation space and an inner/outer guiding structure for guiding the RSU into and out of the RSU accommodation space (inner guiding structure) and/or for guiding the lower frame module with respect to the subsea tree or subsea production tree (outer guiding structure).

Corresponding module locking/unlocking means may be arranged at the upper or lower frame module. According to this modular frame structure, it is possible to exchange particular frame modules to replace them by other modules. Moreover, in case corresponding means of the insertion and setting structure are not only arranged in the upper frame structure, it is also possible to just exchange one frame module in case one of the means has to be replaced.

The corresponding RSU accommodation space will protect the RSU and will also allow a safe lowering of same along the corresponding guidings for correct alignment with respect to the subsea tree and the operation position of the RSU. Moreover, the guidings can be simultaneously used for guiding the lower frame module with respect to the subsea tree. Such guiding will be helpful for better alignment of the RSU with respect to the subsea tree.

Corresponding upper frame module may further comprise two lateral frame cages, each accommodating the locking means and an actuation means to be operated by a ROV or the like. Said actuation means are movably connected to the locking means for displacing same between at least a locking position and a release position. In the locking position the insertion and setting structure is fixed with respect to the subsea tree in a particular position and then the RSU may be lowered to transport same in its operation position within the subsea tree. After arranging the RSU in its position or after removal of the RSU from the subsea tree, corresponding locking means is then placed in release position and the insertion and setting structure can then be lifted by a corresponding lift line or the like to be transported back to sea level.

Different embodiments of such locking means are possible. In an advantageous embodiment of such locking means, each locking means may comprise two latching hooks, each pivotally supported at outer ends of a connection rod, wherein the connection rods are pivotally connected to each other at their inner ends opposite to the outer ends. This means that, by pivoting the connection rods relative to each other, the latching hooks are displaced in a corresponding locking position and a corresponding latching hook will fit into a cut-out or undercuts in the subsea tree structure.

To provide more flexibility in this respect, each hook may be pivotally supported at a mounting block releasably connected to the upper or lower frame module. This means that the latching hooks are pivoted with respect to those mounting blocks wherein the mounting blocks are fixed to one of the frame modules.

To remove any hydraulic components from such a design and to simplify the operation and simultaneously increase the reliability, it is further possible that the inner ends of the connection rods are connected by a rod shaft to which further an activation rod is connected and/or which rod shaft includes end shaft sections guided along guide grooves in lateral guide plates connected to the frame.

The corresponding activation rod will be operated by a ROV or a ROV manipulator, wherein there does not need to be a direct actuation of the activation rod by the ROV, see the following description. Moreover, according to the lateral guide plates, the inner ends of the connection rods are securely guided by corresponding end shaft sections. Such lateral guide plates have a simple structure and are fixed to the frame.

Any vertical impact from the connection of the two connection rods may by absorbed in case lower ends of the lateral guide plates are connected by a support plate on which the inner ends of the connection rods rest in the locking position of the locking means. Moreover, also any other vertical loads will be almost completely diverted into horizontal loads which are mainly absorbed by the connection rods.

For corresponding pivotal connection there will, of course, be some rod shafts, pins, pivot axles or the like. Because of the high loads, the structure has to resist and the available space corresponding pivotal connections are realized by, for example, a rod shaft which is supported in slotted bores in the inner ends of the connection rods which means that no loads are applied to the rod shaft in the slotted holes. For the same reason it is also possible that latching hook and connection rod are pivotally connected by a bolt, wherein a diameter of at least one bore of latching hook and/or connection rod exceeds the diameter of the corresponding bolt. This means that also no loads will be applied to the bolt because the bore hole diameter exceeds the bolt diameter. Instead, corresponding loads will be transferred via surface contact, which means that in locking position, the inner ends of the connection rods can be in surface contact with each other or in locking position the outer ends of each connection rod can be in surface contact with the respective latching hook. Such surface contact is realized by a metal-to-metal contact between the corresponding parts.

As the loads are applied in such a way, it is possible to have a very tight and cost effective design in view of connection rods, latching hooks and all connections as loads will be transferred via such surface contacts.

To securely guide the activation rod when operated by the ROV or the like, a guide sleeve may be provided for guiding the activation rod in an essentially vertical direction wherein the guide sleeve is arranged at upper ends of the lateral guide plates.

To also allow a further displacement of the latching hooks in case of an emergency state and to further allow some fixation of the latching hooks in a particular emergency position, the guide grooves of each lateral guide plate may be continued by a snap-in groove in a snap-in plate, which snap-in groove comprises at least two constrictions from which the lower one defines the release position and the upper one defines a emergency position, in which emergency position the latching hooks are further retracted from the locking position than in the release position.

The activation rod and also the connection rods will be held in this emergency or release position by the corresponding constrictions of the snap-in grooves. This ensures that the running tool can be retrieved from the subsea tree in case of rough running or bending of the activation rod. Such an emergency state will be necessary in case of malfunction of the locking device wherein such emergency state is generally also provided in view of client requirements or industry standards.

It is further possible that in emergency position of the connection rod or activation rod, the guide sleeve is released from a support block to which the guide sleeve and the lateral guide plates are connected by screwing or the like. In view of the activation rod such a connection can be realized by sheer screws like nylon screws or the like which will be sheered off in case of rough-running or bending of the activation rod. Moreover, it is then more easily possible to provide sufficient space to move to such an emergency position which then will be secured according to the constriction of the snap-in grooves.

It was already said that the activation rod will be operated by an ROV and in particular an ROV manipulator arm. To allow easy access for such operation it might be recommendable that the activation rod is pivotally connected at its upper rod end opposite to the guide sleeve to a handle, which is pivotally supported in the lateral frame cage or in other parts of the frame. This handle will then be operated by the ROV to displace the corresponding latching hooks between locking position, release position, and emergency position.

It is further possible that handle and articulation rod are not directly connected, but that between the handle and the upper rod end an articulation rod is arranged. This is pivotally connected to the upper end of the activation rod and also to the handle. For easy access to the handle and for securely holding the handle, the handle may be pivotally supported between lateral support plates of the lateral frame cage by a rotary axis extending therebetween. The corresponding handle is generally designed to withstand all forces the ROV may itself apply to it. In the closed position of the handle, the activation rod is in its upper position, which means that the corresponding connection rods and latching hooks are in the release position. In the open position of the handle the activation rod is in its lower position, which means connection rods and latching hooks are in the locking position.

In case of emergency it will be necessary to further raise the activation rod, see the previous description, wherein this can be easily realized in case the rotary axis is provided with a removal handle to remove the rotary axis. In case the rotary axis which pivotally supports the handle is removed, it is, of course, possible to pull the handle out of its position between the two lateral support plates and to also pull together with the handle the activation rod in its emergency position in which it further extends from the guide sleeve or to pull it with the corresponding guide sleeve released from its support block.

The rotary axis can be removed by the ROV using the corresponding removal handle and then the ROV or also a crane or the like may apply additional forces to the handle to tear off the guide sleeve from the support block and to displace the activation rod in the emergency position together with corresponding latching hooks.

This means it is first possible that the handle is pivotable between a closed and an open position, wherein in the closed position the actuation rod is in its lower and in the open position in its upper position, respectively, with respect to the guide sleeve. Moreover, upon removal of the rotary axis by using the removal handle, the handle can be further vertically displaced with respect to the lateral support plates such that the activation rod is also displaced to its emergency position higher than the upper position. This means that in the emergency position the latching hooks are further retracted as in the release position or in the standard unlocked position. In the emergency position the guide sleeve is broken away from the support block, see the shear screws or nylon screws, and this allows the activation rod to move further upwards. Moreover, the activation and connection rods will be held in this upper position by the corresponding snap-in mechanism, see snap-in grooves of snap-in plates.

To remove the removal hand, the rotary axis may be connected to at least one of the lateral plates by a shear mechanism which may be realized by a shear screw and particularly a nylon screw. This shear mechanism will keep the rotary axis and the removal handle in its pivotal position during standard operation and only in an emergency state the removal handle will be used by the ROV to remove the rotary axis.

There are different possibilities for lowering and lifting the RSU within and relative to the insertion and setting structure. However, in view of possibly high installation or de-installation forces, it is required to reliably generate such forces and moreover, a robust, reliable and compact movement device should be used which can generate corresponding forces in an easy way. For these reasons the lowering and lifting means is a spindle drive with a spindle and a spindle nut, wherein the spindle is rotatably supported within a spindle housing in the upper frame module and the spindle nut is vertically displaceable and connected to a mandrel holding means for releasably holding the mandrel of the RSU. This spindle drive is integrated in the corresponding insertion and setting structure or running tool for installation and de-installation of the retrievable subsea module (RSU). The spindle is able to create the required force to push the RSU into the operating position or to pull it out of same.

For rotating the spindle the ROV is used wherein a corresponding ROV interface may be provided on top of the spindle drive. In particular, a torque tool is deployed by the ROV manipulator, wherein such torque tools are designed to operate rotary units.

It will be further of advantage in case the spindle is connected to a rotation actuator, wherein this is rotatably fixed with respect to the spindle in particular by a sheer pin. The sheer pin will avoid to high loads applied to the spindle drive in case this is already in one of the end positions.

This means, that only the shear pin and may be the rotation actuator have to be replaced in case of such too high loads.

For securely supporting the spindle this may be rotatably supported within the spindle housing by means of axial bearings.

To close the spindle drive in an easy way without any additional means it might be further recommendable that the spindle nut has the shape of a hollow cylinder closed at its lower end, wherein at this lower end the mandrel holding means may be connected.

In such a way, no further housing for the spindle nut is necessary and there is also no further connection between the mandrel holding means and the spindle drive.

Instead, the mandrel holding means is directly connected to the closed end of the spindle nut.

The spindle itself is greased and protected against dirt or water with corresponding protection caps. The axial bearings are axial roller bearings and are located within the spindle housing in an oil filled pressure compensated volume. As already outlined, the corresponding shear pin will protect the spindle drive against overload and is located near the corresponding ROV interface or at the corresponding rotation rod.

At the beginning it was already referred to a module locking/unlocking means wherein this means for releasably holding the RSU may be said mandrel holding means.

A first main function of such a mandrel holding means is of course to lock the lifting mandrel. For this reason the mandrel holding means may comprise at least a receiving space and a mandrel locking means for releasably holding the mandrel in the mandrel receiving space. By such locking of the mandrel the RSU is connected to the spindle drive which is the lowering and lifting means. The spindle drive is actuated by the ROV or some similar tool and by rotating the spindle the spindle nut will then be displaced in vertical direction.

Simple realisation of a corresponding mandrel locking means may be a locking plate which is displaceable in essential horizontal direction between a locking position and an unlocking position. In the locking position the mandrel is fixed within the mandrel receiving space and in the unlocking position it is possible to remove the mandrel holding means from the mandrel by actuation of the spindle drive.

For corresponding holding or releasing of the mandrel the locking plate may comprise a first opening corresponding in diameter to the biggest diameter of the mandrel and an elongated opening with a width smaller than said biggest diameter. In the unlocking position the corresponding first opening is assigned to the mandrel such that the mandrel may be arranged within the mandrel receiving space by actuating of the spindle drive and lowering the mandrel holding means. Thereafter, the mandrel locking means is displaced in the locking position in which the elongated opening will be pulled under the biggest diameter of the mandrel such that the mandrel is now held by the elongated opening with its width smaller than said biggest diameter. In this locking position it is then of course possible to again actuate the spindle drive and to lift the RSU out of its operating position and to pull same into the RSU accommodation space of the insertion and setting structure or of the running tool.

In this position the RSU is then prepared for transport and the insertion and setting structure will to be unlocked from the subsea production tree to be lifted to sea level.

Sometimes it will be necessary to rotate the mandrel prior to pulling the RSU into the corresponding accommodation space or prior to lowering it into its operation position. For this reason the mandrel holding means may further comprise a rotating device for rotating the mandrel as part of the RSU in order to lock the RSU to the structure.

For easy actuation of the locking plate to displace same between locking position and unlocking position the locking plate may have at least along one side surface a toothing which is in engagement with an outer toothing of a first pinion gear, which is rotatably connected to a first actuation means, and in particular to a first ROV interface.

As the ROV interface may be arranged in a more distant position it might be further recommendable that the first pinion gear is connected to the actuating means or ROV interface by a universal joint shaft. This allows an arrangement of the actuation means or ROV interface also not directly above the first pinion gear in vertical direction.

In a similar way also the rotating means may be actuated wherein this can comprise a ring gear with a toothing along its outer circumference, which toothing is in engagement with an outer toothing of a second pinion gear.

This second pinion gear may be rotatably connected to a second actuating means, and in particular to a second ROV interface.

In general those corresponding ROV interfaces will be arranged at different positions in the corresponding insertion and setting structure and it will also be advantageous in case also the second pinion gear is connected to the actuating means or ROV interface by a universal joint shaft.

To better support the pinion and to not directly contact the corresponding pinion gear with the universal joint shaft it is possible that between the first or second pinion gear and the corresponding universal joint shaft a pinion rod is arranged. This is generally arranged coaxial to the pinion gear and at its end opposite to the pinion gear the universal joint shaft is connected to the pinion rod.

To avoid any application of installation forces directly to the lifting mandrel, according to one embodiment of the invention the mandrel holding means comprises a housing in which a corresponding mandrel accommodation space is arranged and in which also the locking plate and the ring gear are movably supported. This means, that any installation forces are transmitted through the housing onto the frame and the corresponding subsea tree. Corresponding de-installation forces will only be applied to the housing and the locking plate. In case the insertion and setting structure arrives in its final position with respect to the subsea tree it is of course possible that some forces or shocks are applied wherein for absorbing such forces and shocks the inserting and setting structure may further comprise damping means which are arranged between the frame of the structure and the subsea tree.

In the following an embodiment of the invention is now described with regards to the following figures.

Figure 16A:
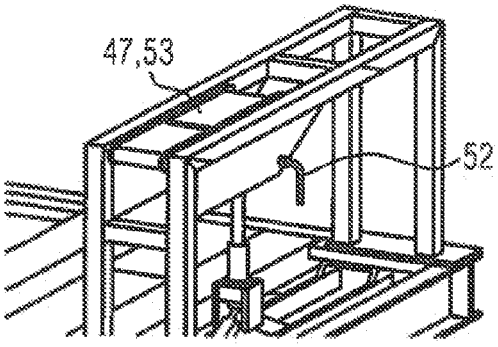
Figure 16B:
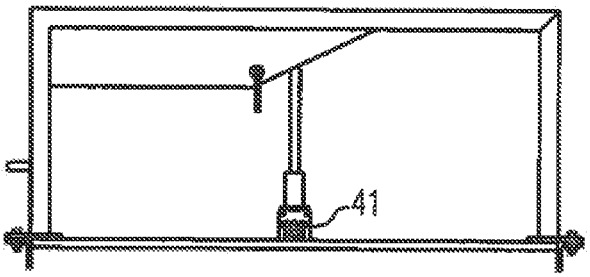
Figure 17A:
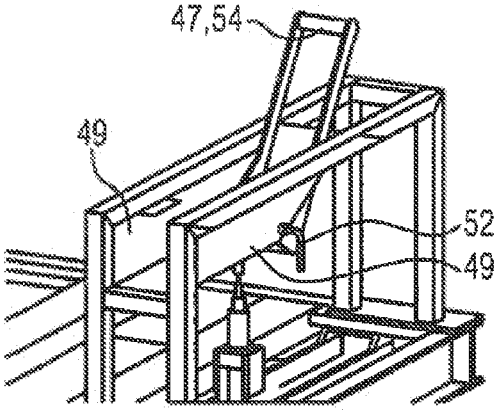
Figure 17B:
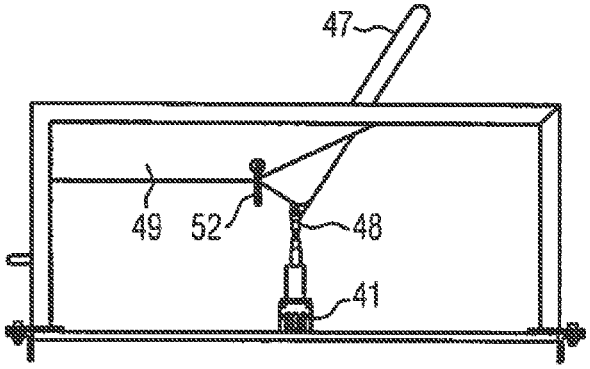
Figure 18A:
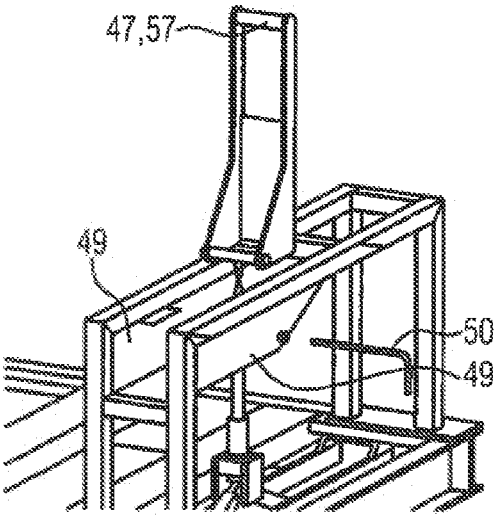
Figure 18B:
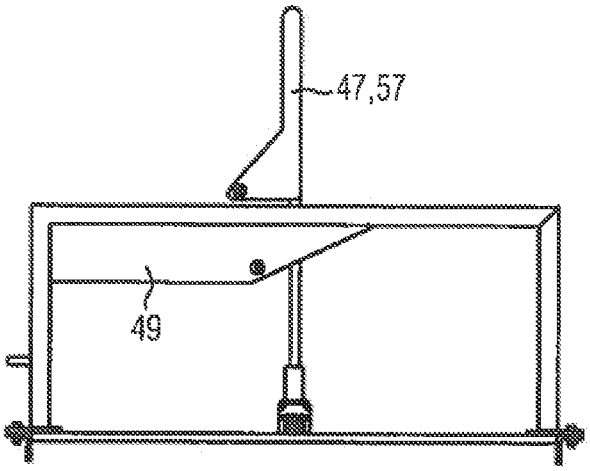
Figure 19:
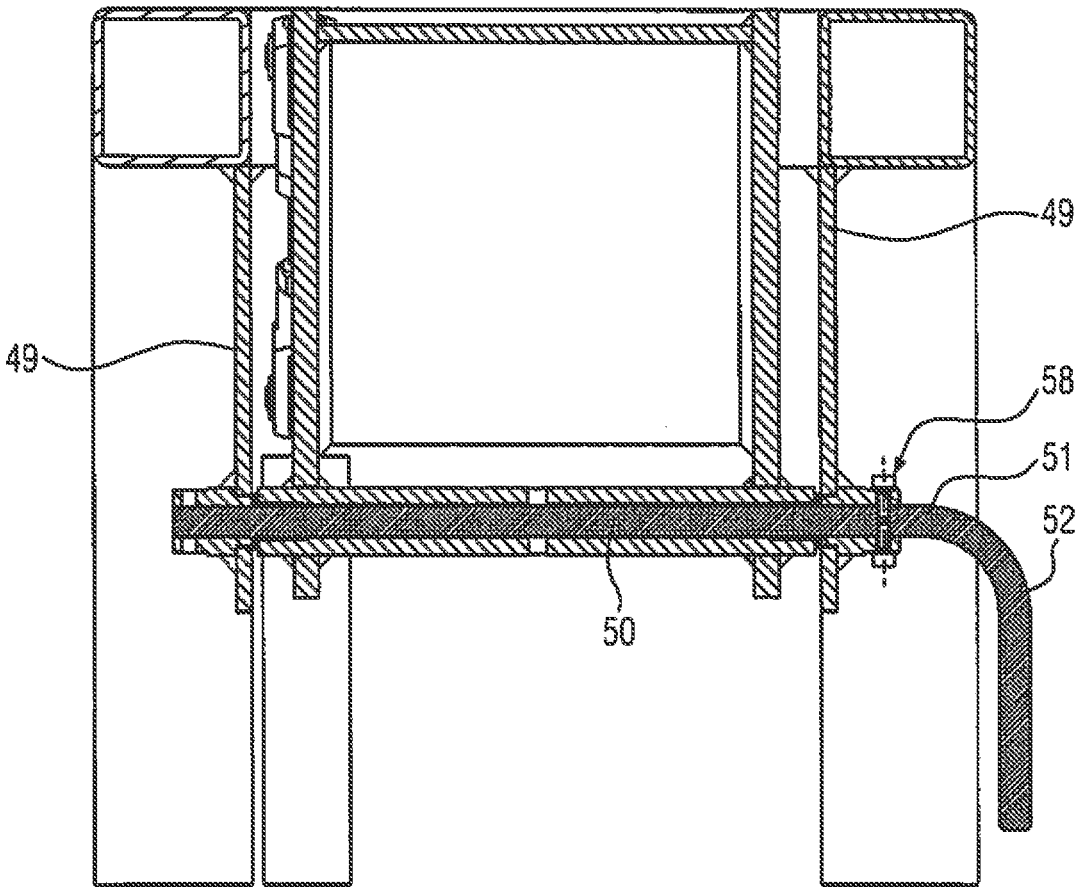
Figure 20:
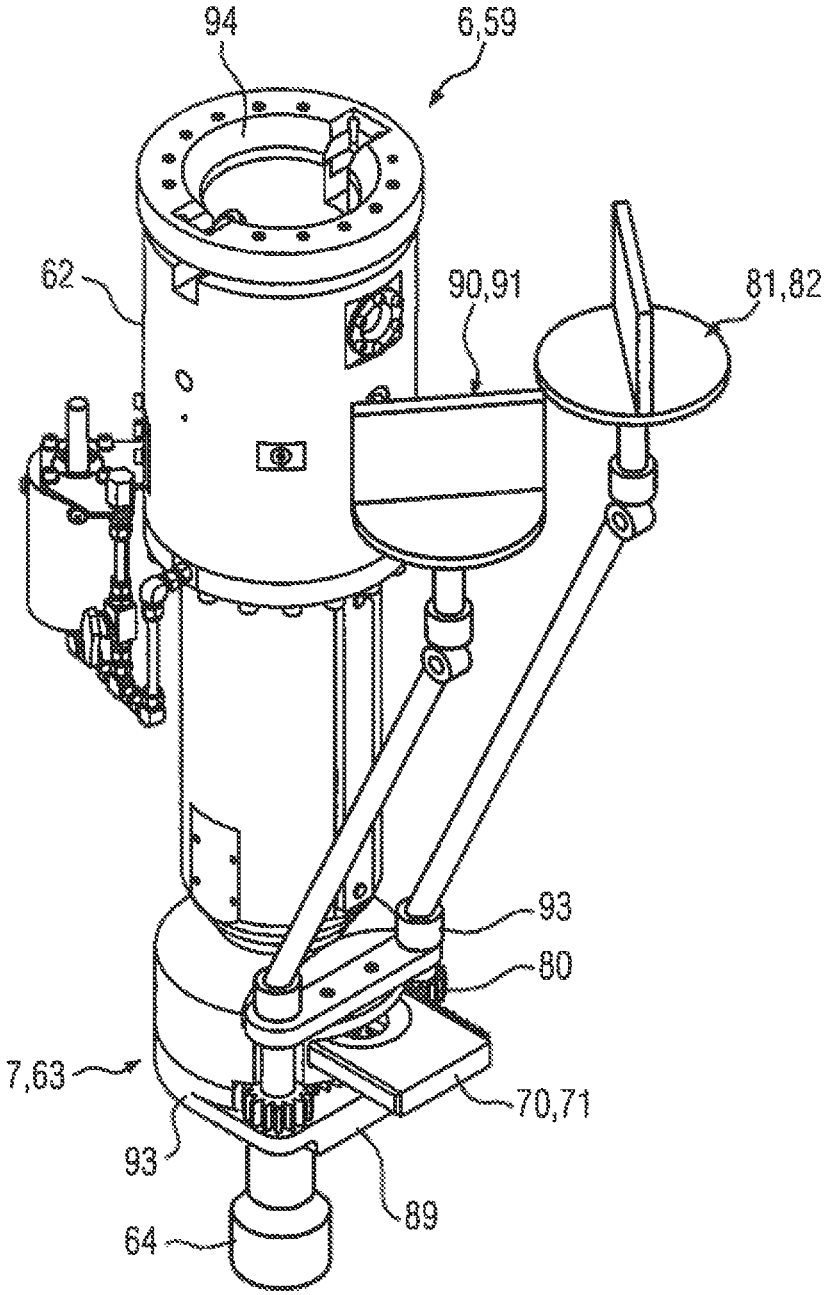
Figure 21:
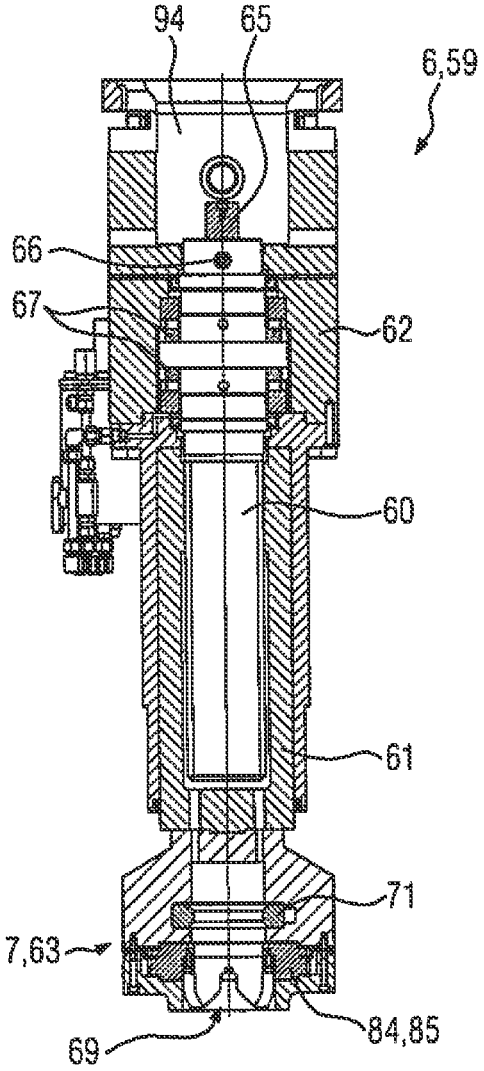
Figure 22:
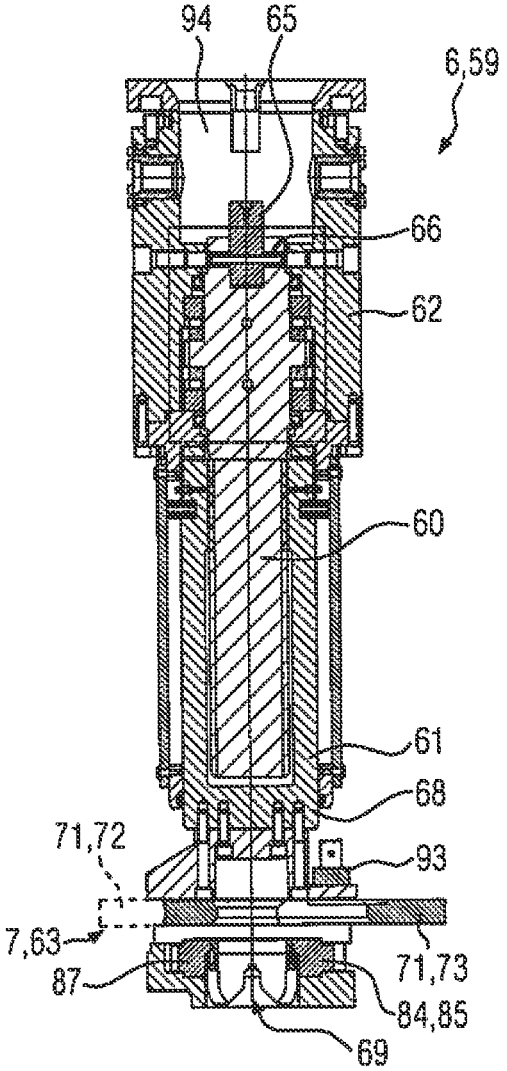
Figure 23:
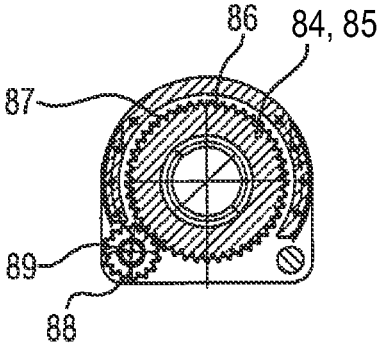

FIGS. 16*a* and *b* show an isometric and side view of handle in open position;

FIGS. 17*a* and *b* show an isometric and side view of handle in closed position;

FIGS. 18*a* and *b* show an isometric and side view of handle in emergency position;

FIG. 19 shows a sectional view of a removal handle as part of handle according to FIGS. 16 to 18;

FIG. 20 shows an isometric view of module locking/unlocking means with lowering and lifting means;

FIG. 21 shows a first sectional view of the means according to FIG. 20;

FIG. 22 shows a further sectional view perpendicular to the sectional view of FIG. 21;

FIG. 23 shows a sectional view along C-C according to FIG. 21, and

Figure 24:
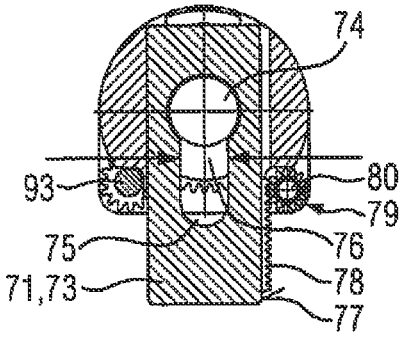

FIG. 24 shows a sectional view along D-D according to FIG. 21.

Figure 1:
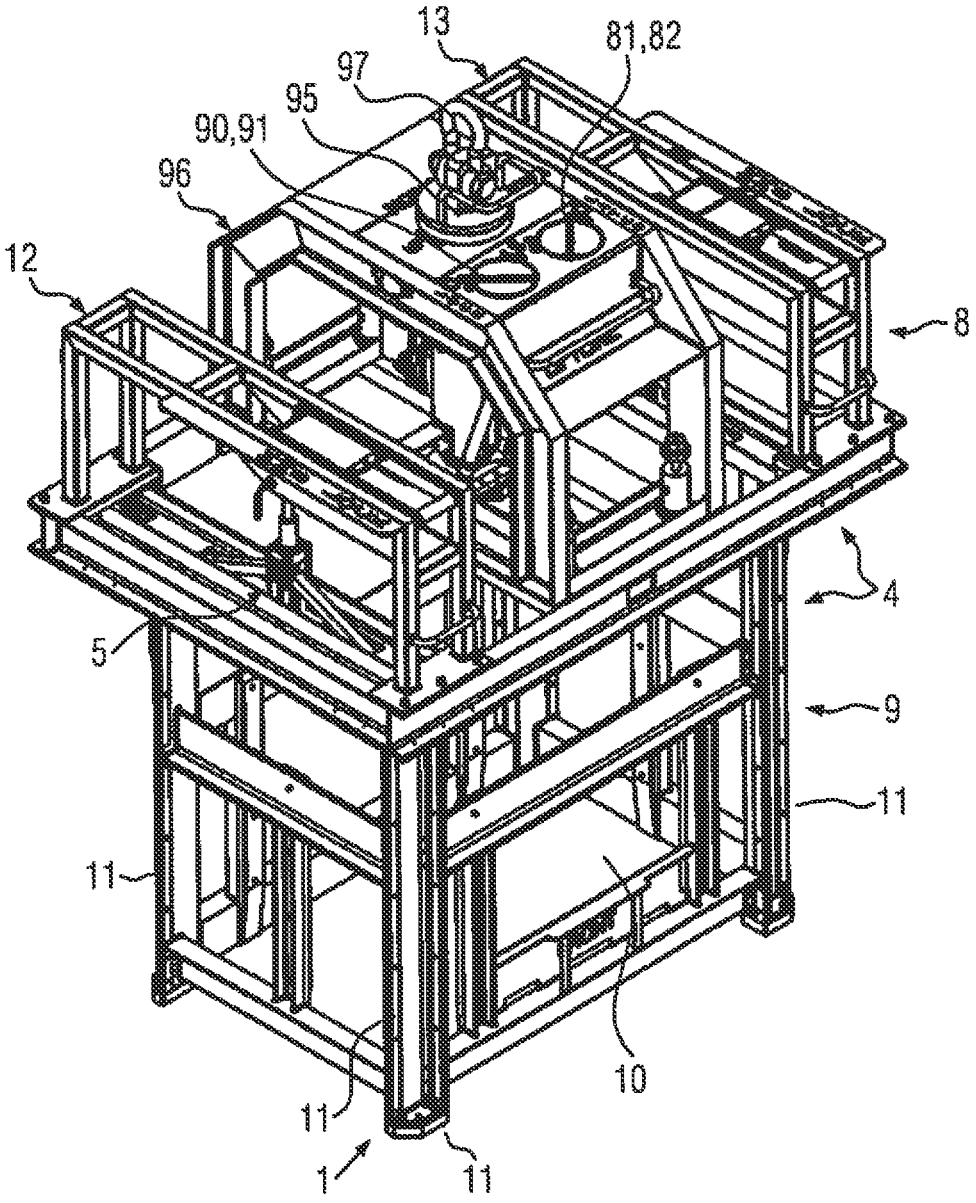
FIG. 1 shows a lateral view of an embodiment of the insertion and setting structure.

In FIG. 1 an isometric view of an embodiment of the insertion and setting structure 1 according to the present invention is illustrated. Such insertion and setting structure 1 is also known as a running tool.

Figure 2:
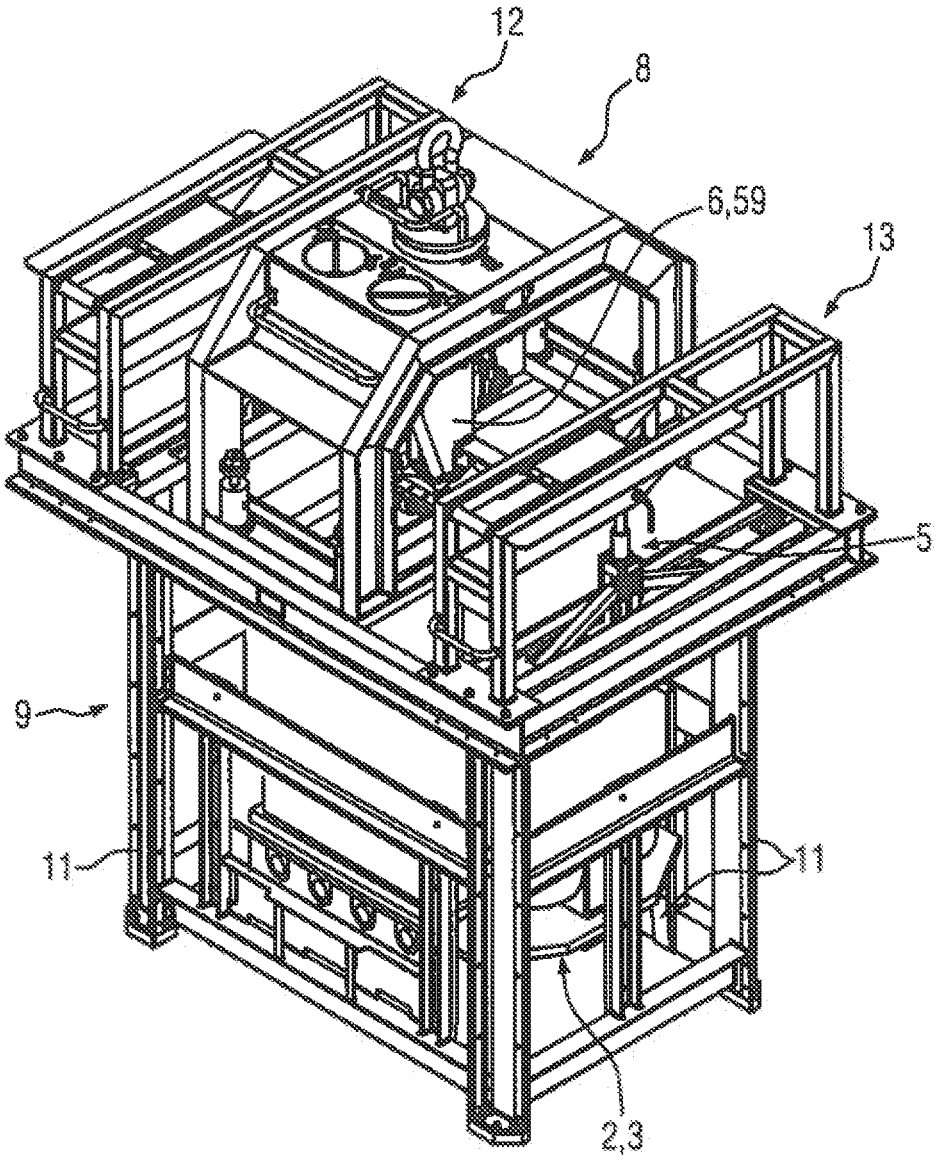
FIG. 2 shows a view similar to FIG. 1 with a retrievable subsea unit within the structure.

This structure is used for transporting a retrievable subsea unit (RSU), see also reference numeral 2 in FIG. 2. The particular embodiment of the RSU is a subsea control module (SCM) (3).

The insertion and setting structure 1 comprises a frame 4 comprising a number of longitudinal and cross beams which are connected to each other. The frame 4 may be separated in upper frame module 8 and a lower frame module 9. Moreover, the upper frame module 8 comprises two lateral frame cages 12 and 13 which are arranged on both sides of a central frame cage 96.

Figure 3:
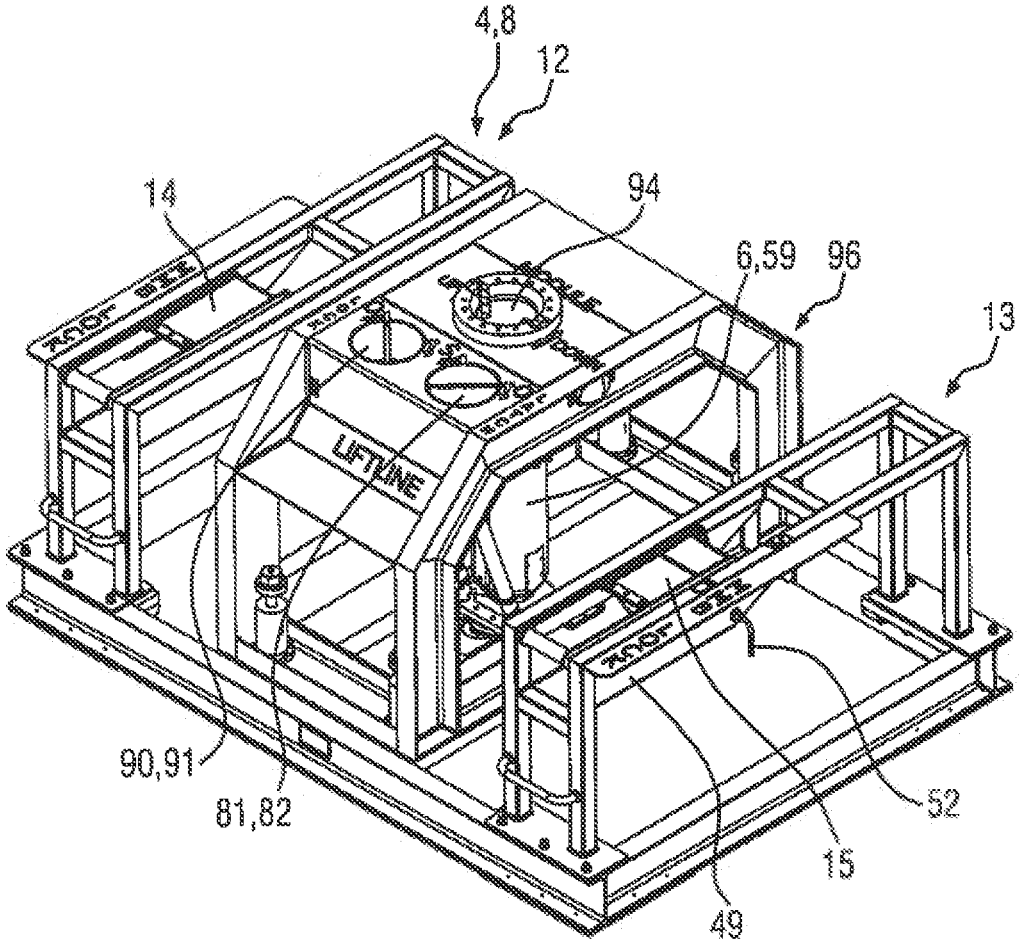
FIG. 3 shows an isometric view of an upper frame module.
Figure 6:
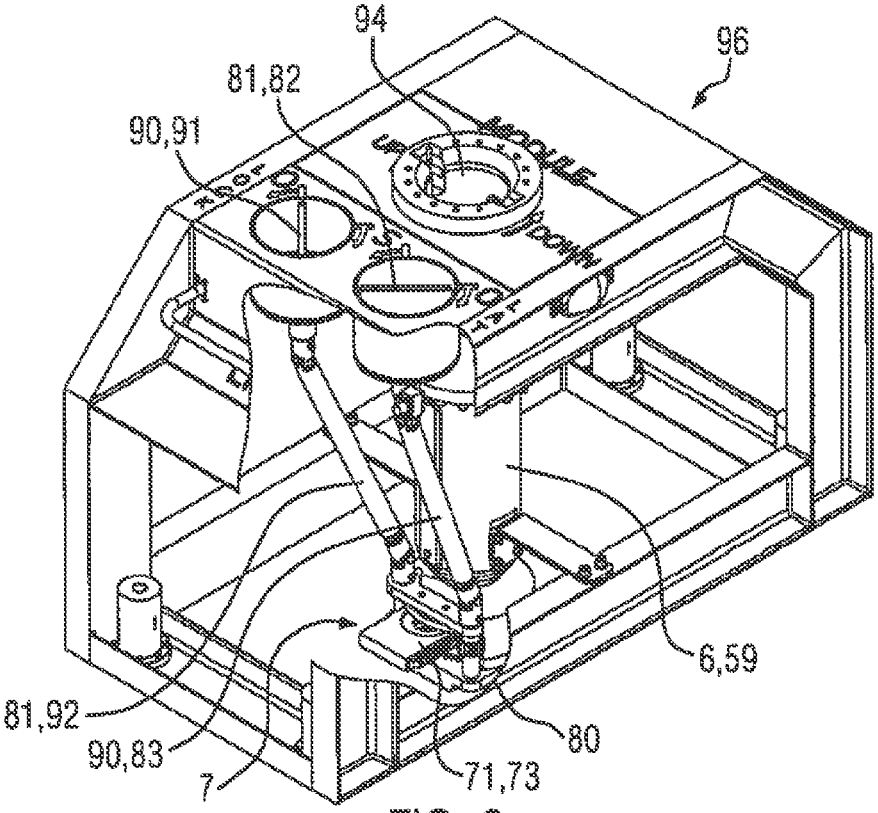
FIG. 6 shows a view similar to FIG. 3 partially broken away.
Figure 7:
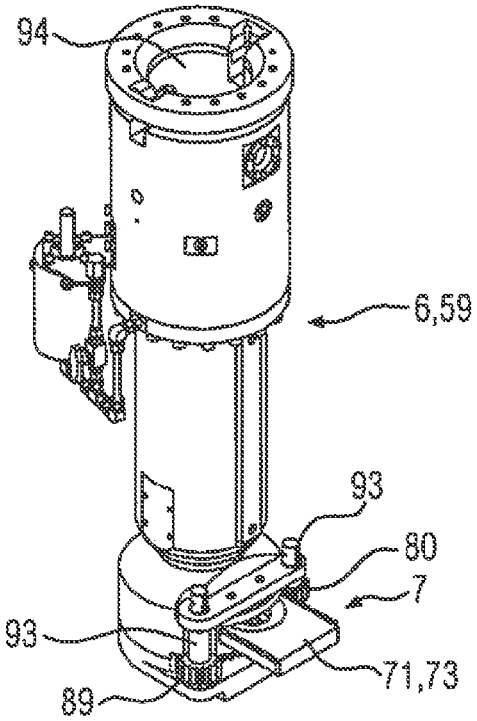
FIG. 7 shows an isometric view of a lowering and lifting means with a module locking/unlocking means.

The frame 4 is used for arranging a locking means 5 which is accommodated in each of the two lateral frame cages 12 and 13, a lowering and lifting means 6, see also FIG. 3, and a module locking/unlocking means 7, see FIGS. 6 and 7. Within the lower frame module 9 a RSU accommodation space 10 is arranged, which means the corresponding space is surrounded by corresponding cross and longitudinal beams of the lower frame module 9. For guiding in particular the lower frame module 9 with respect to a subsea tree or subsea production tree (not illustrated) an inner and outer guiding structure 11 is provided on a number of cross and longitudinal beams.

The inner guiding structure is used for guiding the RSU and the outer guiding structure is used for guiding the RT within the tree.

On the top of the frame 4 a lifting construction 97 is arranged which is used for connecting the insertion and setting structure 1 to a lift line with which the structure is connected to for example a vessel on sea level.

The lifting construction 97 may be removed by actuating, in particular by pushing in, a release bracket 95. For example in FIG. 3 the corresponding lifting construction 97 with release bracket 95 is removed by operating of a remotely operated vehicle (ROV).

In front of the lifting construction two actuating means 81, 90 are arranged, which are first and second ROV interfaces 82 and 91, respectively. Those actuating means are used for rotating universal joint shafts 83 and 92, see also FIG. 6, which are connected to first and second pinion gears 80 and 89 as part of the module locking/unlocking means 7.

In FIG. 2 the insertion and setting structure according to 1 is again illustrated in isometric view wherein, however, a RSU 2 in form of SCM 3 is arranged within the corresponding RSU accommodation space 10 in the lower frame module 9.

The other parts are the same as already outlined with respect to FIG. 1.

FIG. 3 shows an isometric view of only the upper frame module 8 of the frame 4 with the central frame cage 96 and the two lateral frame cages 12 and 13. Each of the two lateral frame cages 12 and 13 is used for accommodating an actuation means 14 and 15 comprising a handle 47, see also FIGS. 16 to 19, wherein each handle is connected to an activation rod 24, see FIG. 4, which is part of the locking means 5.

Each of the corresponding handles 47 of the two actuation means 14 and 15 is pivotally supported within the lateral frame cages 12 and 13 by a rotary axis 50, see also FIG. 19, which has a removal handle 52 at one end thereof.

Figure 4:
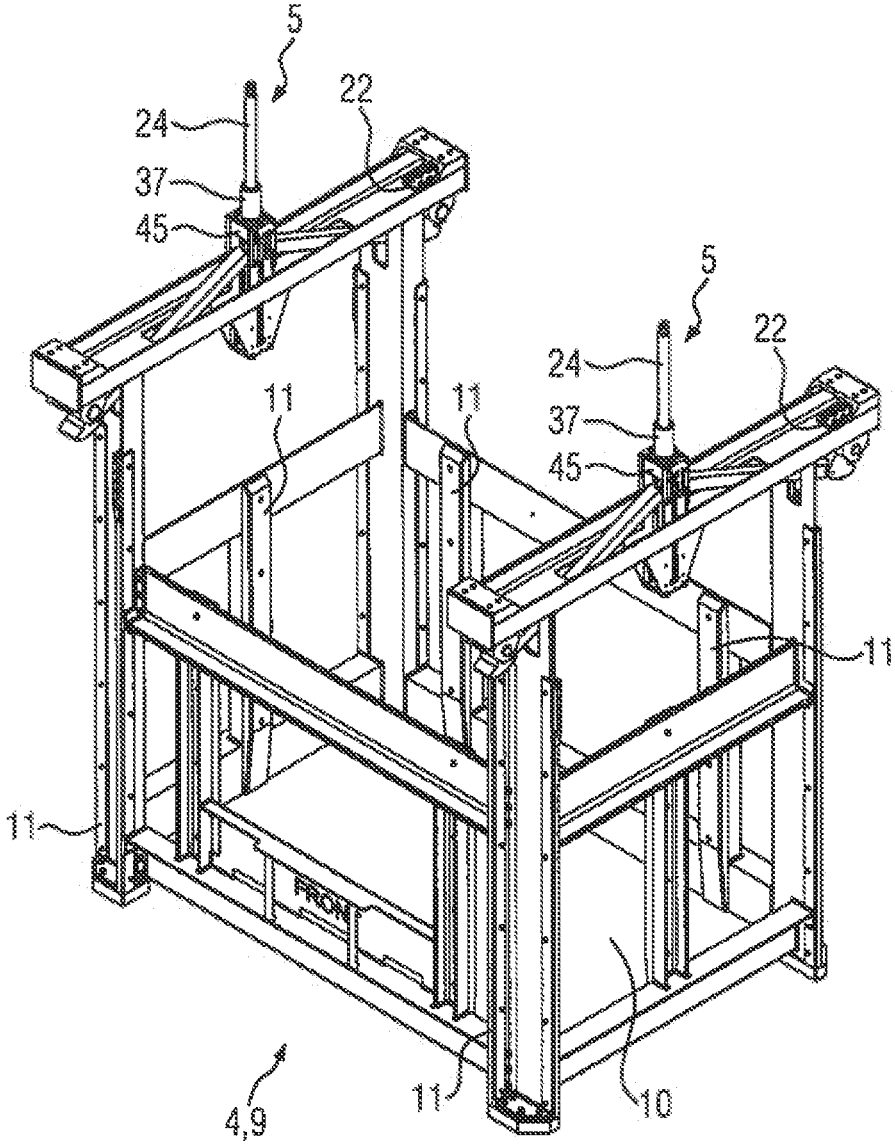
FIG. 4 shows an isometric view of a lower frame module.

The upper frame module 8 according to FIG. 3 may be placed on the upper end of the lower frame module 9, see FIG. 4.

This will result in an overall frame 4 according to FIG. 1.

In FIG. 4 in particular the activation rods 24 of the locking means 5 are visible, which are displaceable in vertical direction and which are supported in guide sleeves 37. The guide sleeves 37 are connected to support blocks 45. According to the position of the activation rods 24 in FIG. 4 corresponding locking means 5 is in its release position 17, see also FIG. 8 or FIG. 11.

Corresponding locking means 5 are connected to the lower frame module 9 by mounting blocks 22, see also FIGS. 8 to 12.

According to FIG. 4 all of the guiding structures 11 are illustrated, which are used for guiding the RSU for lifting and lowering with respect to the RSU accommodation space 10 and which guiding structure 11 is also arranged on outer surfaces of corresponding longitudinal beams for guiding the insertion and setting structure with respect to the subsea tree (not illustrated).

Figure 5:
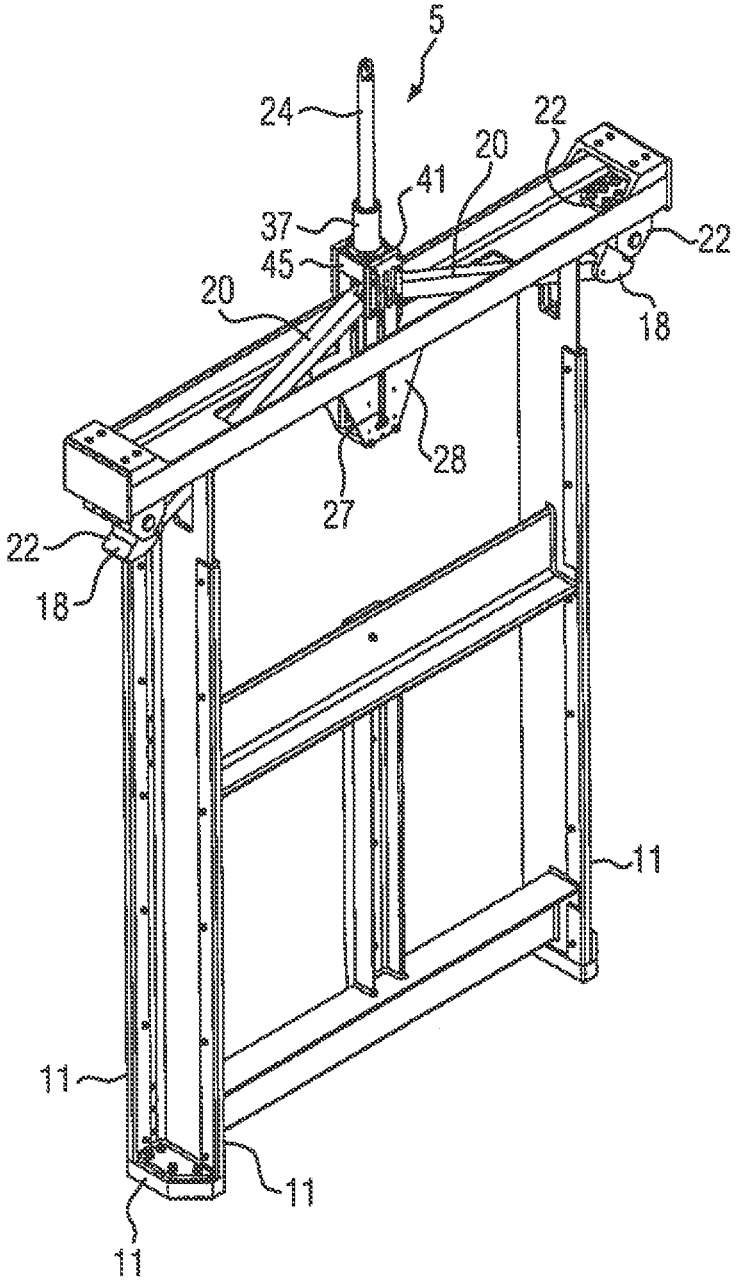
FIG. 5 shows an isometric view of lateral frame parts.

In FIG. 5 only one lateral frame part of the lower frame module 9 is illustrated, wherein in this lateral frame part one locking means 5 is arranged.

This locking means 5 comprises the activation rod 24 which is pivotally connected with connection rods 20 which extend from the activation rod 24 in direction to mounting blocks 22. Below the mounting blocks 22 latching hooks 18 are arranged as a further part of the locking means 5. The latching hooks 18 are pivotally supported at the lower side of each corresponding mounting block 22. In the position according to FIG. 5 the latching hooks 18 and also of course the locking means 5 is arranged in its release position 17. In this position the latching hooks are out of engagement with any cut-outs or undercuts of the corresponding structure of the subsea tree.

Below the corresponding support block 45 to which upper surface the guide sleeve 37 is connected, two lateral guide plates 28 are arranged.

Each of the guide plates 28 comprises a longitudinal guide groove 27. In this guide grooves 27 end shaft sections 25 and 26, see also FIG. 13, are guided which end shaft sections 25 and 26 are part of a rod shaft 23 pivotally connecting the two connection rods 20.

Figure 13:
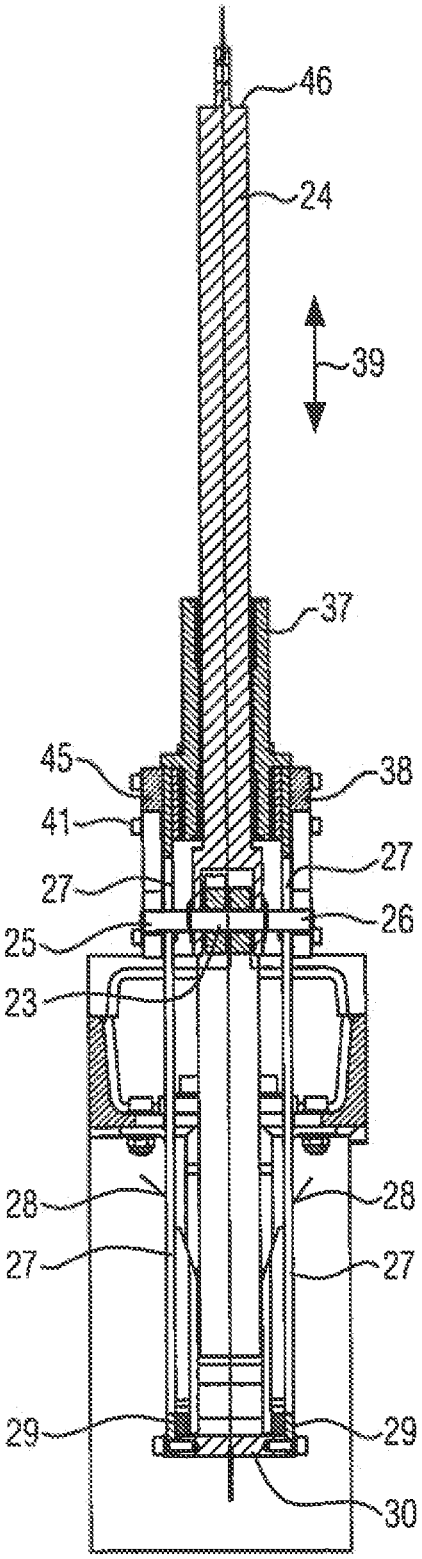
FIG. 13 shows a section view of locking means according to FIGS. 10 to 12.
Figure 14:
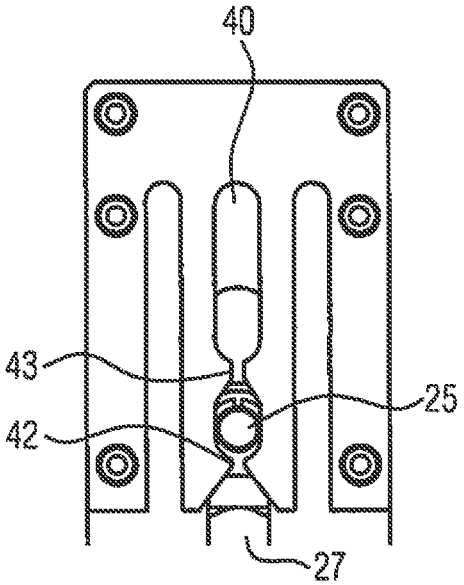
FIGS. 14 and 15 show side views of snap-in plates as part of the locking means.
Figure 15:
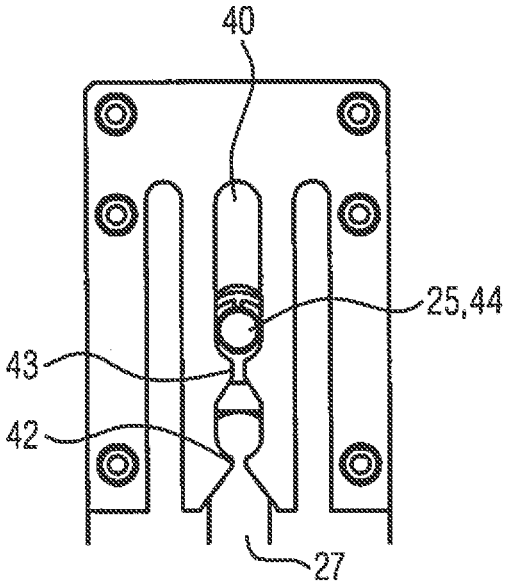

The corresponding guide groove 27 of each lateral guide plate 28 is continued by a snap-in groove 40 of a snap-in plate 41, see also FIGS. 13 to 15.

In FIG. 6 the central frame cage 96 is illustrated wherein the corresponding lifting construction 97, see FIG. 1, is removed such that now a ROV interface 94 is accessible which is used for actuating the lowering and lifting means 6, see also FIG. 7. The corresponding lowering and lifting means 6 is directly arranged beneath the interface 94 and at the lower end of the lowering and lifting means 6 the module locking/unlocking means 7 is arranged.

For actuating this module locking/unlocking means 7 the two actuating means 81 and 90 are used which include the universal joint shafts 83 and 92 and which connect the first and second pinion gears 80 and 89, see FIG. 7, with first and second ROV interfaces 82 and 91 as further parts of first and second actuating means 81 and 90.

According to the modular structure of the frame 4 it is of course also possible to only remove the central frame cage 96 with lowering and lifting means 6 and module locking/unlocking means 7.

The same is true in view of the two lateral frame cages 12 and 13, see for example FIG. 3 or FIG. 4, wherein it is further possible to also remove the lateral frame structures, see FIG. 5, from the lower frame module 9.

In FIG. 7 only the lowering and lifting means 6 with the module locking/unlocking means 7 from FIG. 6 is illustrated. At the upper end of this structure the ROV interface 94 is arranged. Moreover, the corresponding module locking/unlocking means 7 comprises a horizontally displaceable locking plate 71 which is arranged in its unlocking position 73 in FIG. 7. For horizontally displacing the locking plate 71 this comprises a toothing 78 along one side surface 77, see also FIG. 24, wherein an outer toothing 79 of the first pinion gear 80 is in engagement with this toothing 78 of the locking plate 71.

The further and second pinion gear 89 is used for rotating a rotating means 84, see also FIG. 23, which will be discussed later.

Corresponding lowering and lifting means 6 is in this embodiment a spindle drive 59, see also FIGS. 20 to 24.

In FIGS. 8 to 15 the locking means 5 is further described.

Figure 8:
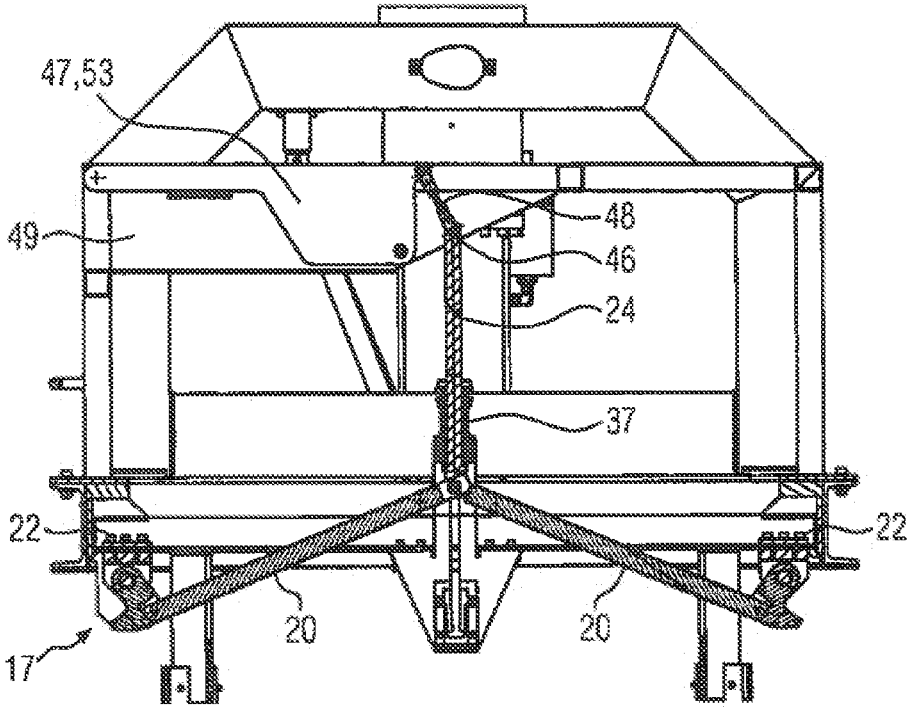
FIG. 8 shows a side view of locking means with handle in open position.

In FIG. 8 a side view of the corresponding locking means 5 is illustrated wherein the locking means is in its release position 17. In this release position 17 the latching hooks 18 are retracted and are not in engagement with any cut-outs or undercuts in the subsea tree and its corresponding structure.

Figure 10:
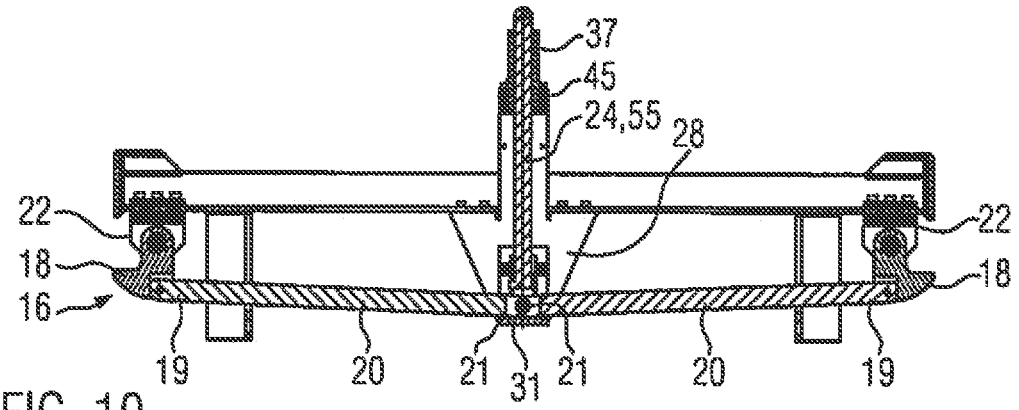
FIGS. 10 to 12 show side views of locking means in a locked position, release position, and emergency position.
Figure 11:
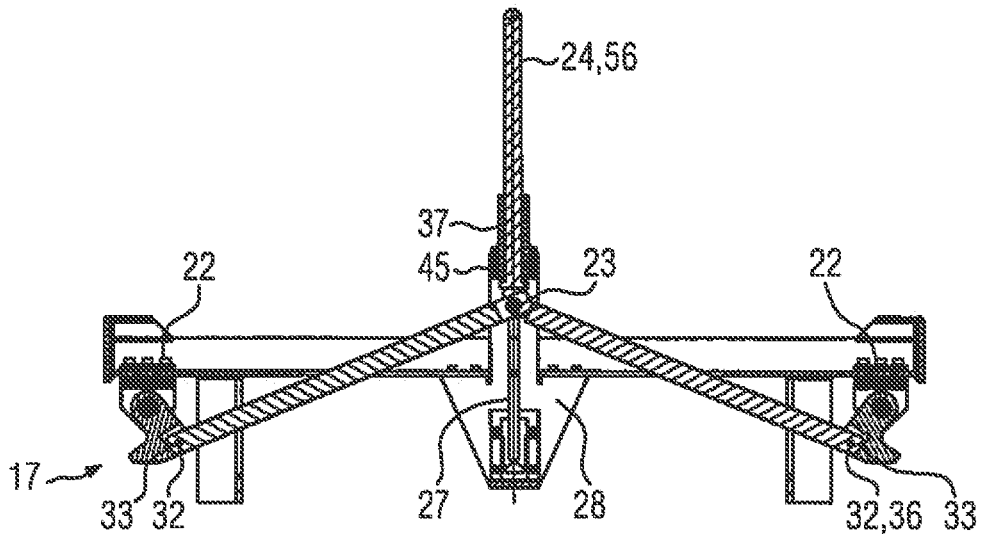
Figure 12:
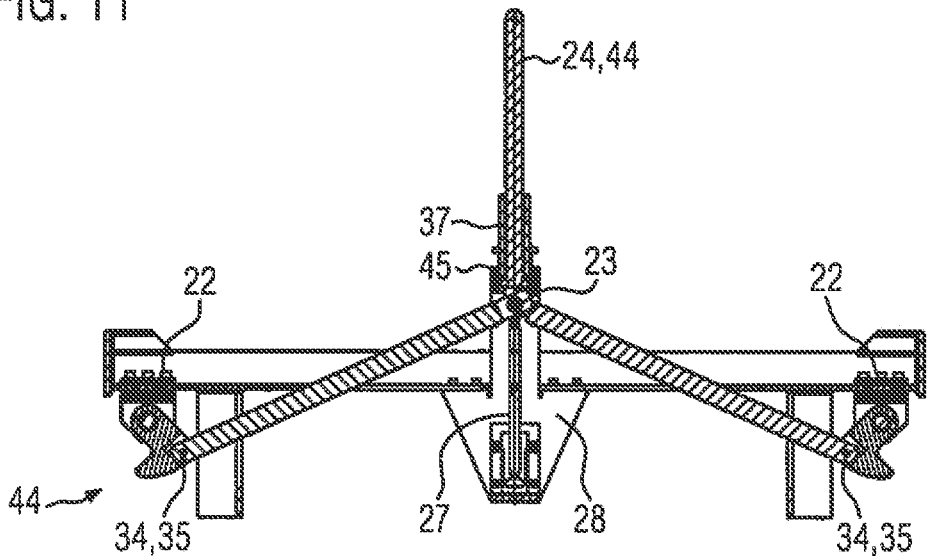

The two connecting rods 20 have inner and outer ends 21, 19, see also FIGS. 10 to 12. At outer ends 19 the latching hooks 18 are pivotally supported and the inner ends 21 of the connection rods 20 are pivotally connected by rod shaft 23 to which also the corresponding activation rod 24 is connected. By displacing the activation rod 24 in vertical direction 39, the two inner ends 21 of the connection rods 20 are also vertically displaced. According to this displacement the latching hooks 18 are pivoted with respect to the mounting blocks 22 at which lower ends the corresponding latching hooks 18 are pivotally supported.

By pivoting the latching hooks 18 to the inside of the corresponding frame they come out of engagement with any cut-outs or undercuts of the subsea tree structure.

As already said the activation rod 24 is vertically guided in corresponding guide sleeve 37 and the upper rod end 46 of the activation rod 24 is connected to an articulation rod 48. This is further connected to handle 47 such that pivoting of the handle 47 will result in a vertical movement of the activation rod 24 and this will result in a lifting or lowering of the inner ends 21 of the connections rods 20 and will further result in a corresponding pivoting of the latching hooks 18, see also in comparison FIG. 9.

Figure 9:
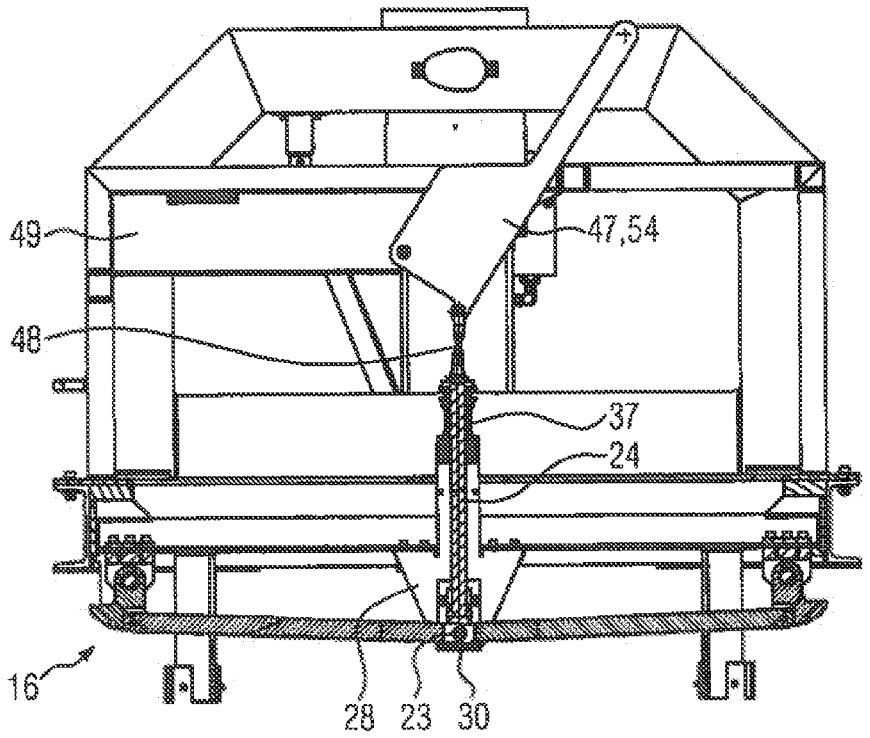
FIG. 9 shows a view corresponding to FIG. 8 with a handle in closed position

In FIG. 8 the handle 47 is arranged in its open position 53 and in FIG. 9 in its closed position 54. Correspondingly, the activation rod 24 is arranged in FIG. 8 in its upper position and in FIG. 9 in its lower position. The upper position corresponds to a release position 17 of the corresponding hooks or locking means 5 and the lower position, see FIG. 9, corresponds to locking position 16 of the hooks or of corresponding locking means 5. Moreover, in FIG. 9 the inner ends 21 of the connection rods 20 rest at the support plate 30 which connects lower ends of corresponding lateral guide plates 28. The inner ends 21 of the connection rods 20 are connected by corresponding rod shaft 23 which has end shaft sections 25 and 26 which are guided along the corresponding guide grooves 27 in each of the lateral guide plates 28. For the connection of the support plate 30 to the lateral guide plates 28, see in particular their lower ends 29, it is also referred to FIG. 13.

In view of the two inner ends 21 it has further to be considered that the corresponding connection rods 20 are connected by the rod shaft 23 which is arranged in a slotted bore 31. According to this arrangement corresponding loads are not transferred to the connection rods only, but in particular vertical loads will be almost completely diverted into horizontal loads which are mainly absorbed by the connection rods wherein any remaining vertical impact will be absorbed by the support plate 30.

Moreover, no loads will be transferred to the corresponding shaft 23 because of the slotted bores 31 but will be transferred via surface contact between the two inner ends 21 of the connection rods 20 or surface contact between outer ends 19 of the connection rods 20 and a corresponding surface of the latching hooks, see in particular FIGS. 10 to 12.

Such surface contact is in particular a metal-two-metal contact.

This allows a decrease of the bolt diameter and will give the opportunity to have a very tight and cost effective design.

In FIGS. 10 and 11 the corresponding locking means 5 is again arranged in locking position, see FIG. 10 in comparison to FIG. 9, or in release position, see FIG. 11 in comparison to FIG. 8. In both cases the corresponding guide sleeve 37 is connected to the support block 45 wherein the connection there between is realized by some shear mechanism and in particular a shear screw or nylon screw.

Also in view of the other connections between the outer ends 19 of the connection rods 20 and the latching hooks 18 corresponding bores 34 or 35 of latching hooks or connection rods have a diameter 33 which is bigger than a corresponding diameter 36 of a bolt 32 used for pivotal connection there between. This means, also here no loads are transferred to the bolt but are transferred by surface contact and in particular metal-to-metal contact between the outer ends 19 and the latching hooks 18, see again FIGS. 10 to 12.

In FIG. 12 the activation rod 24 is lifted more than in FIG. 11 wherein together with the lifting of the activation rod 24 also the guide sleeve 37 was lifted with a result that a corresponding connection between guide sleeve 37 and support block 45 is torn off. The position of activation rod 24 or also of the latching hooks 18 corresponds to an emergency position 44 which is also incorporated in the invention to enable a running to retrieval in case of malfunction of the locking means 5. Such a requirement also complies with client requirements or industry standards. Corresponding sheer means realized by nylon screws or the like with which the guide sleeve is fitted to the support block are sheered off in case of rough-running or bending of the activation rod. According to this quite high position of the activation rod and corresponding pivoting of the latching hooks 18 to the inside of the frame sufficient space is provided to move the insertion and setting structure away from corresponding subsea tree structure.

In FIG. 13 a sectional view of the corresponding locking means 5 according to FIGS. 10 to 12 is illustrated. The two lateral guide plates 28 are arranged in a particular distance to each other and are provided with the guide grooves 27 along which the end shaft sections 25 and 26 of the rod shaft 23 are guided. A corresponding rod shaft 23 connects the inner ends 21 of the connection rods 20 and also connects the actuation rod 24 to those inner ends. The actuation rod 24 is vertically guided in the guide sleeve 37 which is fixed to the support block 54 which is also fixed to the lateral guide plates 28 and 4 to the snap-in plates 41, see also FIGS. 14 and 15. Those snap-in plates 41 are arranged in such a way that the guide grooves 27 of the lateral guide plates 28 are continued by at least one snap-in groove 40 in each of the snap-in plates 41, see again FIGS. 14 and 15.

Also upper ends 38 of the lateral guide plates 28 are connected to the support block 45. According to FIG. 13 the guide sleeve 37 is still connected to the support block 45, see also FIG. 11, and the activation rod 24 is arranged in its upper position corresponding to the release position 17 of the locking means 5, see also FIG. 11. In case the activation rod 24 is further lifted, see FIG. 12, the guide sleeve 37 will be separated from the support block 45 by shearing off the corresponding connection, see the shear screws or nylon screws.

This allows a further lifting of the activation rod 24 wherein this will result in a further lifting of the inner ends 21 of corresponding rod shaft 23, see FIG. 15. In FIG. 14 the corresponding end shaft section 25 and 26 are already arranged in the snap-in grooves 40 of snap-in plates 41 and just passed a first constriction 42 in corresponding snap-in groove 40. This arrangement in abutment with a first constriction 42 corresponds to the arrangement according to FIG. 13 or FIG. 11 which represents the release position 17 of the locking means 5. In case the end shaft sections 25 and 26 are further lifted and pass the second constriction 43 the corresponding locking means will then be arranged in the emergency position 44, see also FIG. 12. In such an emergency position the latching hooks 18 are further retracted from any engagement with the subsea tree structure than in the release position, see FIGS. 14 and 11 or also FIG. 8. Nevertheless, in each of the particular positions with respect to the constrictions 41 or 43 activation and connection rods will be held in their release or emergency position.

In FIGS. 16 to 19 it is now referred to the handle to be actuated by the ROV, see also FIGS. 1, 2, 3, 8 and 9.

As already said the handle 47 is pivotally supported between lateral support plates 49 of the lateral frame cages 12 and 13 wherein the rotary axis 50 is used for this support which extends between the two lateral support plates 49, see also FIG. 19.

In FIGS. 16*a* and *b* the handle 47 is arranged in open position 53 according to which the activation rod 24 is arranged in its upper position 56, which means the locking means 5 is in its release position 17. As already outlined, see in particular FIGS. 8 and 9, between an upper end 46 of the activation rod 24 and a rear side of the handle 47 the articulation rod 41 is arranged as a connection there between.

The rotary axis 50 has at one end 51 the removal handle 52 which may be actuated by a ROV to remove same, see FIGS. 18*a* and *b*.

In FIGS. 17*a* and *b* the handle 47 is in its closed position 54 according to which the activation rod 24 is arranged in its lower position which means the locking means 5 is in its locking position 16.

Furthermore, in FIGS. 18*a* and *b* the rotary axis 50 is removed by using the removal handle 52 and in such a case the handle 47 may just be lifted by the ROV or by also other tooling or crane such that the handle 47 is lifted without any further connection for example to the lateral support plates 49. By such lifting of the handle 47 the activation rod 24 is moved into the position according to FIG. 12, wherein in this position also the guide sleeve 37 is separated from the support block 45. Moreover, the end shaft sections 25 and 26 of the rod shaft 23 are arranged above the second constriction 43 in the snap-in grooves 40 of snap-in plates 41, see FIG. 15. This position of the handle 47 is an emergency position 57 which correspond to emergency position 44 of the locking means 5.

In FIG. 19 a sectional view of the handle in particular in the area of the rotary axis 50 is illustrated. The rotary axis 50 is rotatably supported by and is connected to at least one lateral support plate 49 by a shear mechanism 58 in form of a shear screw or nylon screw. In case the rotary axis 50 is removed by using the removal handle 52, see FIG. 18*a*, this shear mechanism 58 is destroyed and rotary axis can be pulled out wherein in such a case the handle 47 may be lifted as illustrated in FIGS. 18*a* and *b* without any connection to its support structure, see lateral support plates 49. The rotary axis is in general cases removed by the ROV using the removal handle 52. For lifting the handle according to FIG. 18*a* or *b* not only the ROV may be used, but also any crane or there like arranged at sea level or further additional subsea tooling. This removal of the rotary axis 50 represents an emergency release mechanism which might be required to disconnect the handle from the frame in case of malfunction of the connected mechanics.

In FIGS. 20 to 24 the lowering and lifting means 8 with module locking/unlocking means 7 is illustrated, see also FIGS. 6 and 7. It was already said that the lowering and lifting means 6 is integrated in the running tool in form of a spindle drive for installation and de-installation of the RSUs. Such a spindle drive 59 can create the required axial forces to push the RSU into its host structure in the subsea tree or to pull it out of same. The spindle drive comprises a spindle 60, see also FIGS. 21 to 24, and a spindle nut 61. The spindle 60 is rotatably supported within a spindle housing 62 and the spindle nut 61 is displaceable in vertical direction along the spindle 60 in case this is rotated.

The spindle 60 is rotatably supported by a number of axial roller bearings 67 within the spindle housing 62 and at an upper end of the spindle 60 a rotation actuator 65 is arranged which forms part of the ROV interface 94. This means, the ROV and in particular an operating arm of same can be connected to the ROV interface 94 and also to the rotation actuator 65. This is then rotated and together with the rotation actuator also the spindle 60 will rotate which results in a vertical displacement of the spindle nut 61. The corresponding rotation actuator 65 is connected to the spindle 60 by a shear pin 66 which protects the spindle and also the running tool against overload. For turning the spindle a high torque is needed. For such high torques the ROV will use a special torque tool, like a class 4 torque tool.

The spindle nut 61 has a form of a hollow cylinder which is closed at its lower end 68. At this lower end 68 the mandrel holding means 63 is arranged which forms a corresponding module locking/unlocking means 7. The mandrel is for example illustrated in FIG. 20, see reference numerals 64.

FIGS. 21 and 22 represent two sectional views of the embodiment in FIG. 20 which are perpendicular to each other. Within the mandrel holding means 63 a mandrel receiving space 69 is formed which is used for accommodating corresponding mandrel 64, see FIG. 20. To fix the mandrel within the mandrel receiving space a mandrel locking means 70 is actuated. This mandrel actuating means 70 has the form of a locking plate 71, see FIGS. 20, 22 and 24. In FIGS. 20, 22 and 24 this locking plate 71 is arranged in its unlocking position 73. In this position, a first opening 74 with a diameter corresponding to the biggest diameter of the mandrel is arranged within the mandrel receiving space 69 such that the mandrel may be introduced in same. In case the locking plate 71 is displaced in its locking position 72, see FIG. 22 and dashed line, the first opening 74 is also displaced and an elongated opening 75 in connection with a first opening and also formed in the locking plate 71 will be arranged within the mandrel receiving space 69 below the biggest diameter of the mandrel such that this is then fixed. A corresponding width 76 of this elongated opening 75, see FIG. 24, is smaller than the corresponding biggest diameter of the mandrel 64.

For displacing the locking plate 70 it has a toothing 78 along a side surface 77, see FIG. 24. An outer toothing of the first pinion gear 80 is in engagement with this side surface toothing 78. The corresponding first pinion gear 80 is connected to the first actuating means 81 or first ROV interface 82, see also FIG. 20, such that the first pinion gear 80 can be rotated by the ROV using the first ROV interface 82. Such rotation of the first pinion gear 80 will displace the locking plate 71 in horizontal direction to align the first opening 74 or the elongated opening 75 with the mandrel receiving space 69.

It might also be necessary that the lifting mandrel, which is rotatable with respect to the RSU, is rotated by some angle by the lowering and lifting means. This is in particular necessary in case the RSU has to be locked with respect to the RSU accommodation space 10 in the lower frame module 9. For such rotation of the lifting mandrel the rotating means 84 is part of the module locking/unlocking means 7. Such rotating means 84 comprises a ring gear 85, see FIGS. 21 to 24 which is arranged below the locking plate 71. The ring gear 85 has a toothing 86 along its outer circumference 87. An outer toothing 88 of the second pinion gear 89 is in engagement with this circumferential toothing 86 of the ring gear 85, see FIG. 23. According to FIG. 20 also this second pinion gear 89 is connected to a corresponding second actuating means or a second ROV interface 91, see also FIGS. 7 and 6. The rotation of the lifting mandrel causes a locking block beneath the RSU to be rotated and this is used for locking/unlocking the RSU with respect to the RSU or free structure. A potential misalignment of the RSU is covered by the guiding structure.

Each of the corresponding pinion gears 80 and 89 can be connected to a corresponding pinion rod 93 which is then used to be connected to a corresponding universal joint shaft 83 or 92 which extends from the pinion rod 93 to the corresponding first or second ROV interfaces 82 and 91, respectively.

With respect to the spindle housing it is further to be considered, that this is used for protecting the spindle and also for greasing same, wherein the axial roller bearings are located within an oil filled pressure compensated volume. All of the insertion and setting structure 1 according to the present invention is working without any additional hydraulics wherein hydraulics may only be used for producing a corresponding torque by the ROV for rotating the spindle. The spindle can provide the possibly high installation or de-installation forces and will moreover reliably generate such forces. Moreover, the corresponding lowering and lifting means 6 with the directly attached module locking/unlocking means 7 is a robust, reliable and compact device which may generate corresponding installation forces in an easy way.

According to the present application it is also possible that only some of the means of the insertion and setting structure are combined. For example, it is possible to only use the particular locking means 5 but to realise lowering and lifting and module locking and unlocking by other means. Moreover, instead of the locking means 5 other locking means may be used wherein in this respect then corresponding lowering and lifting means and/or module locking/unlocking means according to the description above may be used. It is also possible that lowering and lifting means and module locking/unlocking means are separated from each other which will, however, result in a less compact structure.

It is further possible, that the frame of the insertion and setting structure 1 is realised by other modules like upper and lower frame modules. It is for example, also possible, that the lateral frame parts, see FIG. 5, are separate modules which are connected to another frame module.

Furthermore, it is possible that the locking means 5 are not arranged in the lower frame module, but in the upper frame module and in particular in the lateral frame cages 12 or 13.

Moreover, it is further possible to arrange damping means at the frame of the inserting and setting structure which will come into contact with a structure of the subsea tree to damp any shocks or the like which may result from arranging the frame of the structure within a corresponding subsea tree structure.

The invention claimed is:

1. A running tool configured to insert and set a retrievable subsea unit (RSU) into a subsea tree, said running tool comprising:

a frame comprising a lock configured to lock and unlock the running tool with respect to the subsea tree, a drive configured to lower or lift the RSU with respect to an accommodation space of the subsea tree, and a module lock configured to releasably lock the RSU to the drive, wherein the lock comprises a rod shaft, at least two connection rods, and at least two hooks, wherein each of the at least two connection rods comprises a first end pivotally coupled to the rod shaft and a second end pivotally coupled to at least one hook of the at least two hooks, and wherein the lock is configured to move between a locking position in which the at least two hooks are in a first position that enables the at least two hooks to engage a subsea structure to lock the running tool with respect to the subsea tree and a release position in which the at least two hooks are in a second position that enables the running tool to move relative to the subsea tree.

2. The running tool of claim 1, wherein the frame comprises:

an upper frame comprising at least one of the lock, the drive, and the module lock; and a lower frame comprising a RSU accommodation space configured to receive the RSU.

3. The running tool of claim 1, wherein each of the at least two hooks is pivotally supported at a respective mounting block that is releasably connected to the frame.

4. The running tool of claim 1, comprising an activation rod coupled to the rod shaft and an actuator, wherein the actuator is configured to drive the activation rod vertically between an upper position and a lower position to cause the lock to move between the locking position and the release position.

5. The running tool of claim 4, comprising a guide sleeve configured to surround and support the activation rod as the activation rod moves vertically relative to the guide sleeve between the upper position and the lower position.

6. The running tool of claim 4, comprising a support block, lateral guide plates coupled to the support block, and a guide sleeve coupled to the support block via one or more shear pins, wherein the rod shaft is configured to move within a respective guide groove of each lateral guide plate, the activation rod is configured to move through the guide sleeve, and wherein in an emergency position the guide sleeve is released from the support block via shearing the one or more shear pins.

7. The running tool of claim 4, wherein an upper rod end of the activation rod is pivotally connected to the actuator.

8. The running tool of claim 4, wherein the actuator comprises a handle that is pivotally supported between lateral support plates of the frame by a rotary axis extending there between.

9. The running tool of claim 8, wherein the handle is pivotable between an open position and a closed position, wherein in the open or closed position the activation rod is arranged in its lower or upper position, respectively.

10. The running tool of claim 8, comprising a removal handle coupled to the rotary axis and configured to enable removal of the rotary axis to enable vertical displacement of the handle with respect to the lateral support plates, such that the activation rod is displaceable to an emergency position higher than the upper position with respect to the lower position.

11. The running tool of claim 1, wherein the rod shaft comprises end shaft sections guided along guide grooves formed in lateral guide plates supported by the frame, and lower ends of the lateral guide plates are connected by a support plate on which the first ends of the at least two connection rods rest in the locking position of the lock.

12. The running tool of claim 1, wherein the rod shaft is supported in respective slotted bores formed in the first ends of the at least two connection rods.

13. The running tool of claim 1, wherein at least one hook of the at least two hooks and the respective connection rod are pivotally connected by a bolt, wherein a diameter of at least a bore of the at least one hook or of the respective connection rod exceeds a bolt diameter of the bolt.

14. The running tool of claim 1, comprising lateral guide plates supported by the frame, wherein the rod shaft is configured to move within a respective guide groove of each lateral guide plate, wherein each respective guide groove is continued by a snap-in groove in a snap-in plate, wherein each snap-in groove comprises a first constriction that defines the release position and an upper constriction that defines an emergency position in which the at least two hooks are further retracted from the locking position than in the release position.

15. The running tool of claim 1, comprising a mandrel holder that defines an opening configured to receive and support a mandrel coupled to the RSU, wherein the drive comprises a spindle drive comprising a spindle and a spindle nut coupled to the mandrel holder, and rotation of the spindle causes vertical displacement of the spindle nut and the mandrel holder, thereby lowering or lifting the RSU.

16. The running tool of claim 15, wherein the module lock comprises a lock plate configured to move through the opening defined by the mandrel holder between a first position and a second position, wherein the lock plate comprises a first opening that enables insertion of the mandrel coupled to the RSU into the opening defined by the mandrel holder when the lock plate is in the first position and a second opening that blocks withdrawal of the mandrel from the opening defined by the mandrel holder when the lock plate is in the second position.

17. A running tool configured to insert and set a retrievable subsea unit (RSU) into a subsea tree, said running tool comprising:

a frame supporting a lock configured to lock and unlock the running tool with respect to the subsea tree, wherein the lock comprises a rod shaft, at least two connecting rods, and at least two hooks, wherein each of the at least two connecting rods comprises a first end pivotally coupled to the rod shaft and a second end pivotally coupled to at least one hook of the at least two hooks, and wherein the lock is configured to move between a locking position in which the at least two hooks are in a first position that enables the at least two hooks to engage a subsea structure to lock the running tool with respect to the subsea tree and a release position in which the at least two hooks are in a second position that enables the running tool to move relative to the subsea tree.

18. The running tool of claim 17, comprising an activation rod coupled to the rod shaft and an actuator, wherein the actuator is configured to drive the activation rod vertically between an upper position and a lower position to cause the lock to move between the locking position and the release position.

19. A running tool configured to insert and set a retrievable subsea unit (RSU) into a subsea tree, said running tool comprising:

a drive configured to lower or lift the RSU with respect to an accommodation space of the subsea tree; and a module lock configured to releasably lock the RSU to the drive;

wherein the module lock comprises a mandrel holder that defines an opening configured to receive and support a mandrel coupled to the RSU, a lock plate configured to move through the opening between a first position in which the lock plate enables insertion of the mandrel coupled to the RSU into the opening defined by the mandrel holder and a second position in which the lock plate blocks withdrawal of the mandrel from the opening defined by the mandrel holder.

20. A running tool configured to insert and set a retrievable subsea unit (RSU) into a subsea tree, said running tool comprising:

a frame comprising a lock configured to lock and unlock the running tool with respect to the subsea tree, a drive configured to lower or lift the RSU with respect to an accommodation space of the subsea tree, and a module lock configured to releasably lock the RSU to the drive, wherein the frame comprises:

an upper frame comprising at least one of the lock, the drive, and the module lock; and a lower frame comprising a RSU accommodation space configured to receive the RSU.

* * * * *